US009895701B2

(12) United States Patent
Tian et al.

(10) Patent No.: US 9,895,701 B2
(45) Date of Patent: Feb. 20, 2018

(54) SHOWER WATER ROTATING STRUCTURE

(71) Applicant: Xiamen Bright Showers Co., Ltd., Xiamen (CN)

(72) Inventors: Chong Tian, Xiamen (CN); Kaihuang Zhu, Xiamen (CN); Liangliang Zhang, Xiamen (CN)

(73) Assignee: XIAMEN BRIGHT SHOWERS CO., LTD., Xiamen, Fujian (CN)

( * ) Notice: Subject to any disclaimer, the term of this patent is extended or adjusted under 35 U.S.C. 154(b) by 15 days.

(21) Appl. No.: 15/073,639

(22) Filed: Mar. 17, 2016

(65) Prior Publication Data

US 2016/0296950 A1 Oct. 13, 2016

(30) Foreign Application Priority Data

Apr. 13, 2015 (CN) ..... 2015 1 0171509

(51) Int. Cl.
*B05B 1/18* (2006.01)
*B05B 1/08* (2006.01)
*B05B 3/04* (2006.01)

(52) U.S. Cl.
CPC ..... *B05B 1/083* (2013.01); *B05B 1/18* (2013.01); *B05B 3/04* (2013.01)

(58) Field of Classification Search
CPC ..... B05B 1/083; B05B 1/18; B05B 1/1636; B05B 3/04
USPC ..... 239/99, 100, 447, 449
See application file for complete search history.

(56) References Cited

U.S. PATENT DOCUMENTS 4,190,207 A * 2/1980 Fienhold ..... B05B 1/18 138/46
4,303,201 A * 12/1981 Elkins ..... B05B 1/1636 239/381
5,433,384 A * 7/1995 Chan ..... B05B 1/1636 239/239
5,862,985 A * 1/1999 Neibrook ..... B05B 1/1636 239/428.5
8,066,203 B2 * 11/2011 Zhou ..... B05B 1/1636 239/443
9,067,222 B2 * 6/2015 Gransow ..... B05B 1/18

* cited by examiner

*Primary Examiner* — Alexander Valvis
(74) *Attorney, Agent, or Firm* — Leong C. Lei

(57) ABSTRACT

A shower water rotating structure includes a main body having a water inlet and water outlet, and a rotating disk, pinion, water inclining support, impeller and rotors arranged top to bottom inside the main body; the water inclining support has inclined water inlet adapted to guide water flow to impact the impeller to rotate the impeller configured with a drive gear adapted to drive the pinion to rotate; the pinion is configured with a guide rod adapted to drive the rotating disk to rotate; the rotating disk is distributed radially with guide grooves for the staged matching with the guide rod; and a lower part of rotating disk is configured with a gear adapted to drive the rotors having an inclined water hole and capable of being rotated in the water outlet of the main body, thereby realize spray having a pulsating rotating water effect.

9 Claims, 10 Drawing Sheets

SHOWER WATER ROTATING STRUCTURE

TECHNICAL FIELD OF THE INVENTION

The present invention relates to a bathroom product, and more particularly to a shower water rotating structure.

DESCRIPTION OF THE PRIOR ART

Current shower heads are variable in shape and style; users' requirements for them are not only the shapes thereof but the functions and water comfort thereof. Current shower heads may have various water types such as shower water, column water, massage water and fall water, allowing users to choose, where conventional structures for outputting pulsating massage water mostly use water to impact impeller to form intermittent water flow to hit a person's body to generate a sometimes strong and sometimes weak massage-like feeling to the person, the output water being soft and comfortable. But, such kind of massage water effect formed simply by impeller structured is not ideal, having no obvious pulsating massage effect.

SUMMARY OF THE INVENTION

The object of the present invention is to provide a shower water rotating structure, capable of improving the pulsating effect of output water so as to enhance a shower water massage function, allowing shower to be more comfortable and relax.

To achieve the object mentioned above, the present invention proposes a shower water rotating structure, including a main body having a water inlet and water outlet, and a rotating disk, pinion, water inclining support, impeller and rotors arranged top to bottom inside the main body, the water inclining support having inclined water inlet adapted to guide water flow to impact the impeller to rotate the impeller being configured with a drive gear adapted to drive the pinion to rotate, the pinion being configured with a guide rod adapted to drive the rotating disk to rotate, the rotating disk being distributed radially with guide grooves for the staged matching with the guide rod, and a lower part of rotating disk being configured with a gear adapted to drive the rotors having an inclined water hole and capable of being rotated in the water outlet of the main body.

A upper part of the rotating disk is further configured with a water separating disk, and a peripheral of the water separating disk is configured with water passing gaps.

The water separating disk is a disk body, a upper surface thereof close to a periphery thereof is formed with convex edges, notches are distributed on the convex edges, and the water passing gaps are distributed on the water separating disk outside the convex edges.

The rotating disk is a circular disk body, a projecting rod matching with a through hole is extended downward from a middle part of the circular disk body, a gear is configured on a lower end of the projecting rod, guide grooves are distributed radially on a lower surface of the circular disk body, a closed positioning seat for the positioning of the pinion is formed between each two adjacent guide grooves, and a deep seat allowing the guide rod of the pinion to be passed through is formed between each positioning seat and the projecting rod.

A guide concave arc is formed on a periphery of a lower surface of the circular disk body between each two adjacent guide grooves.

A guide rod is configured on a matching face of the pinion with the rotating disk close to a periphery thereof, and a guide convex arc operated in coordination with the guide concave arc is configured on an opposite side to the guide rod.

A positioning rod operated in coordination with the positioning seat of the rotating disk is formed on a middle part of the pinion between the guide rod and guide convex arc of the pinion, and another side of the positioning rod is formed with an engagement seat matching with the water inclining support.

The water inclining support is a post cover, a middle part thereof is formed into a partitioning plate adapted to divide the post cover into a upper seat and lower seat, a middle part of the partitioning plate is configured with a matching hole allowing the drive gear of the impeller to be passed through, one side of the matching hole of the partitioning plate is configured with a projecting bar matching with the pinion, the rotating disk and pinion are accepted in the upper seat, the impeller is accepted in the lower seat, and the inclined water inlets are configured on a side wall of the lower seat.

A drive gear in engagement with the pinion is configured on a upper part of an axle of the impeller with an engagement hole, and a periphery of a lower par of the axle is formed with leaves, the axle of the impeller allowing the projecting rod of the rotating disk to be matched therewith by extension of the projecting rod therein.

The rotor is a water body configured with an inclined water hole, the water hole on the rotor having an included angle with a rotation axis of the rotor, and a upper end edge of the rotor is formed with a driven gear in engagement with the gear of the rotating disk.

Whereby, the present invention drives the pinion adapted to drive the rotating disk to rotate intermittently through the impeller having the drive gear, and the rotating disk then drives the rotors having an inclined water hole in such a way to realize spray having a pulsating rotating water effect, improving shower water massage function, allowing shower to be more comfortable and relax.

BRIEF DESCRIPTION OF THE DRAWINGS

FIGS. 6A-1 to 6A-6 respectively are a schematically cross-sectional view of the present invention derived from FIG. 6A, showing the pinion driving the rotating disk when shower water is being sprayed out.

DETAILED DESCRIPTION OF THE PREFERRED EMBODIMENTS

Figure 1:
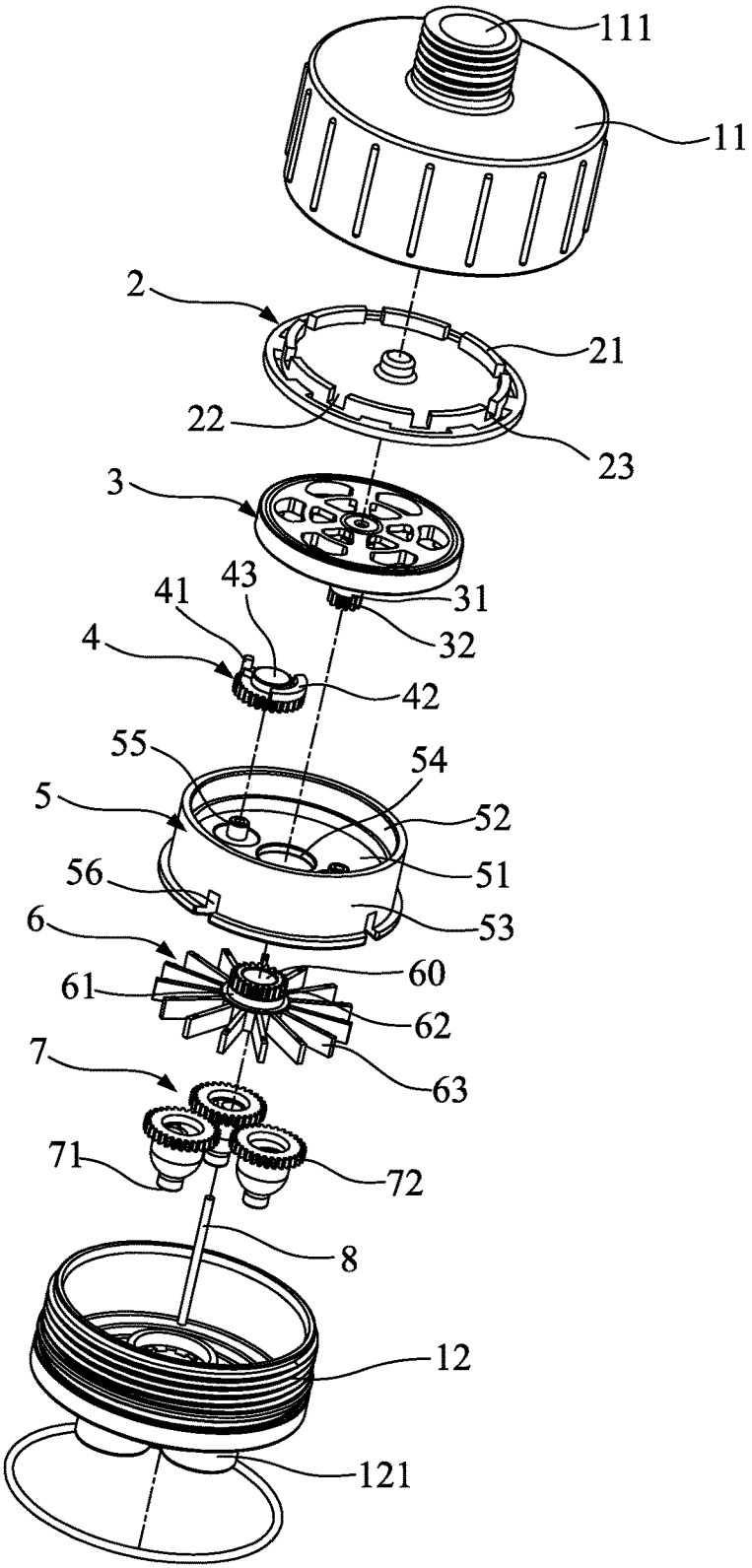
FIG. 1 is an exploded view of the present invention.

Referring to FIGS. 1 to 7, a shower water rotating structure of the present invention includes a main body 1 having a water inlet 111 and water outlet 121 and a rotating disk 3, pinion 4, water inclining support 5, impeller 6 and rotors 7 arranged from top to bottom inside the main body 1, where the water inclining support 5 has an inclined water inlet 56 adapted to guide water flow to impact the impeller 6 to rotate, the impeller 6 is configured with a drive gear 62 for driving the pinion 4 to rotate, and the pinion 4 is configured with a guide rod 41 driving the rotating disk 3 to rotate, with the rotating disk 3 being distributed radially with guide grooves 33 for the staged matching of the guide rod 41, while the lower part of the rotating disk 3 is configured with a gear 32 adapted to drive the rotor 7 having inclined water holes 71 and capable of being rotated in the water outlet 121 of the main body 1.

Furthermore, the upper part of the rotating disk 3 is configured with a water separating disk 2, on the periphery of which water passing gaps 23 are configured.

The main body 1 is constituted by engaging a upper housing 11 with a lower housing 121, between them is formed with an accommodation space for the accommodation of the components mentioned above, the water inlet 111 for the connection with a water supplying hose is configured on the top of the upper housing 11, and the water outlet 121 allowing the rotors 7 to be extended in and mated with it the bottom of the lower housing 12.

The water separating disk 2 is a disk body, on the upper surface of which close to the periphery is configured with convex edges 21, on which notches 22 are distributed. Furthermore, the water passing gaps 23 are distributed along the periphery on the water separating disk outside the convex edges 21. It is noted that the convex edges 21 and notches 22 are configured in such a way to speed water flow.

Figure 3:
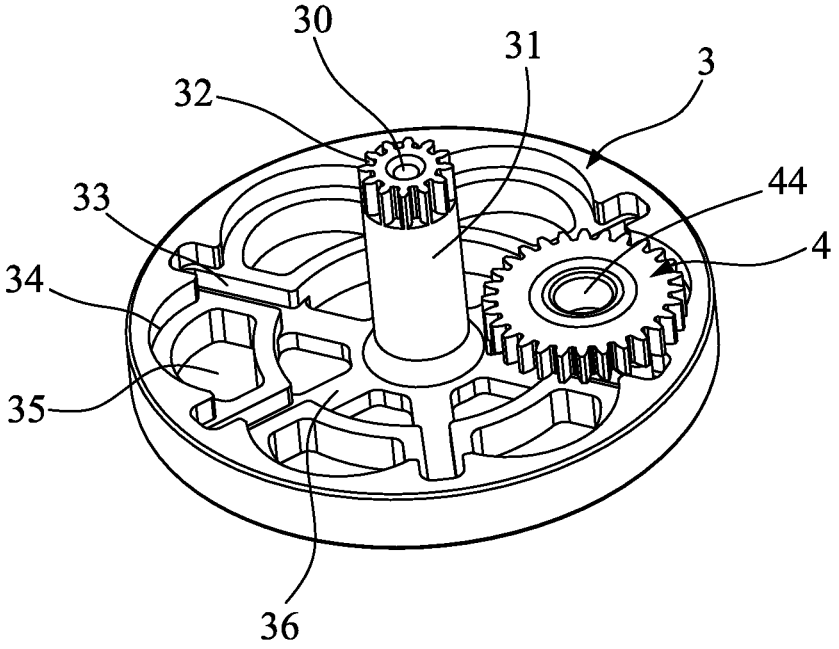
FIG. 3 is a schematically perspective view of a rotating disk in engagement with the pinion according to the present invention.
Figure 3A:
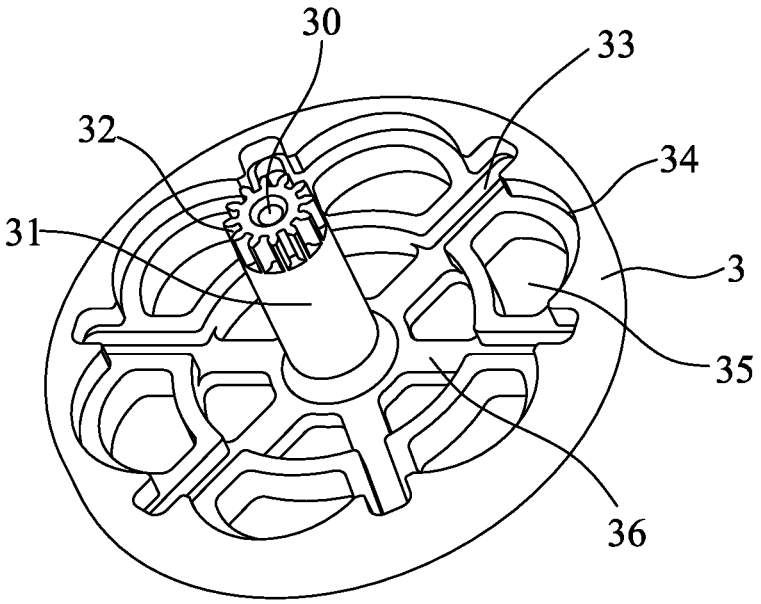
FIG. 3A is a schematically perspective view of the rotating disk of the present invention.

Further referring to FIG. 3A, the rotating disk 3 is a circular disk body, the middle part of which is extended with a projecting rod 31 having a matching through hole 30, and a gear 32 is configured on the lower end of the projecting rod 31. Furthermore, guide grooves 33 are distributed radially on the lower surface of the circular disk body; a guide concave arc 34 is formed on the periphery of the circular disk body between each two adjacent guide grooves 33; a closed positioning seat 34 is further formed between each two adjacent guide grooves on the lower surface of the circular disk body; between each positioning seat 35 and the projecting rod 31 is formed with a deep seat 36 allowing a guide rod 41 of the pinion 4 described below to be passed through. Here, the number of the guide grooves 33 depends on the outer diameter and tooth number of the pinion 4.

Figure 3B:
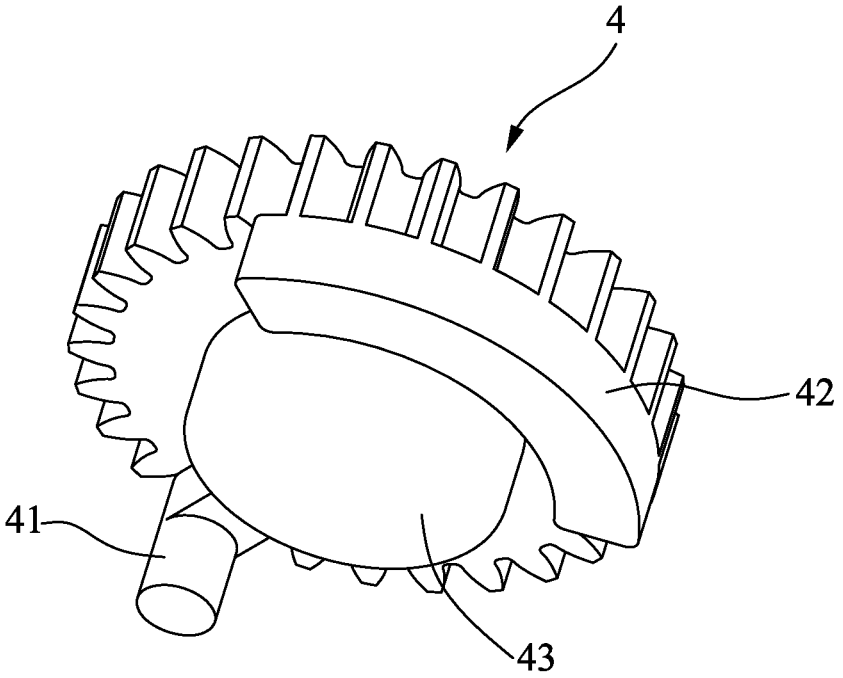
FIG. 3B is a schematically perspective view of the pinion of the present invention.

Still further referring to FIG. 3B, the matching face of the pinion 4 with the rotating disk 3 close to the periphery is configured with a guide rod 41 operated in coordination with the guide grooves 33, and the side of the matching face opposite to the guide rod 41 is further configured with a guide convex arc 42 operated in coordination with the guide concave arc 34. Furthermore, a positioning rod 43 is formed on the middle of the pinion 4 between the guide rod 41 and guide convex arc 42, and an engagement seat 44 is formed on another side of the positioning rod 43.

Referring to FIG. 3, the positioning rod 43 of the pinion 4 is inserted in the positioning seat 35 and the guide rod 41 is extended in the guide groove 33 when the pinion 4 is operated in coordination with the rotating disk 3.

The water inclining support 5 is a post cover, where a partitioning plate 51 is formed in the middle thereof to divide it into a upper seat 52 and lower seat 53, Furthermore, a matching hole 54 is configured on the middle of the partitioning plate 51, and a projecting bar 55 in engagement with the engagement seat 44 of the pinion 4 is configured at one side of the matching hole 54 of the partitioning plate 51, where the rotating disk 3 and pinion 4 are accepted in the upper seat 52, and the impeller 6 in the lower seat 53, with inclined water inlets 56 being configured on the side wall of the lower seat 53.

Figure 2:
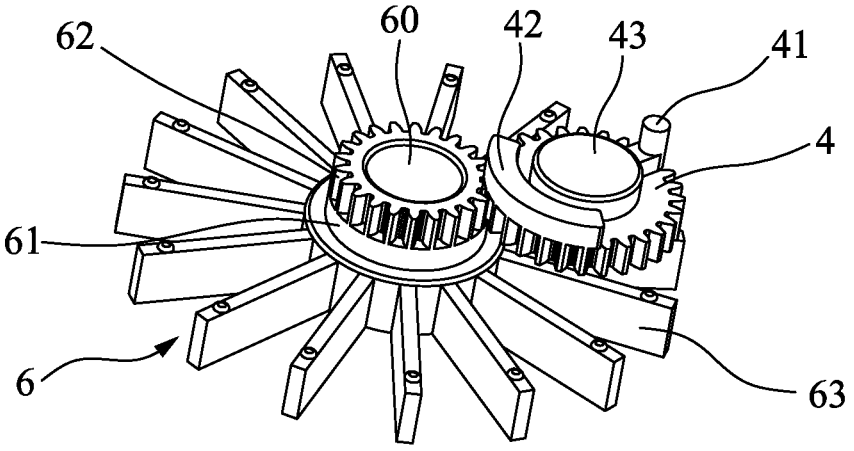
FIG. 2 is a schematically perspective view of an impeller in engagement with a pinion according to the present invention.

Referring to FIG. 2, the impeller 6 has an axle 61 with an engagement hole 60, on the upper part of which a drive gear 62 for the engagement with the pinion 5 is configured, and a plurality of leaves 63 are formed on the lower part of the periphery of the axle 61.

Figure 4:
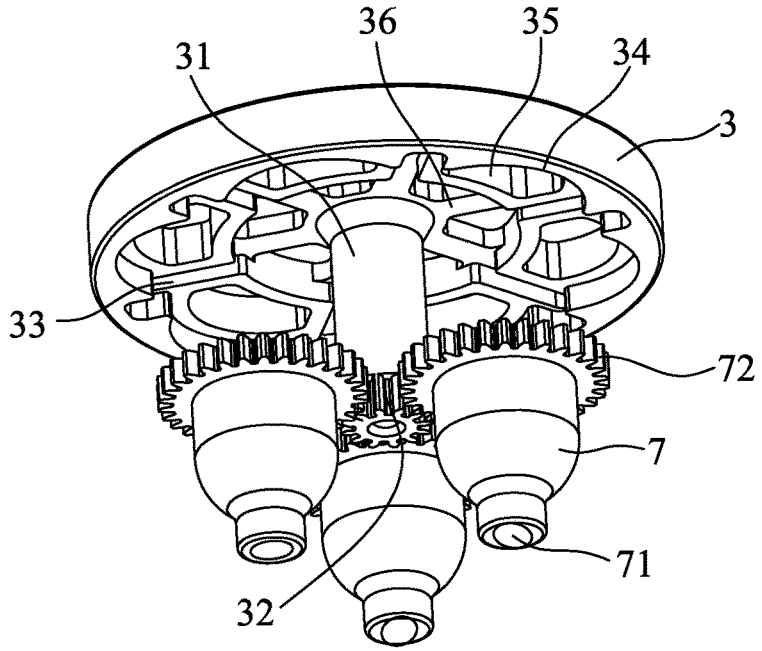
FIG. 4 is a schematically perspective view of the rotating disk in engagement with rotors according to the present invention.
Figure 5:
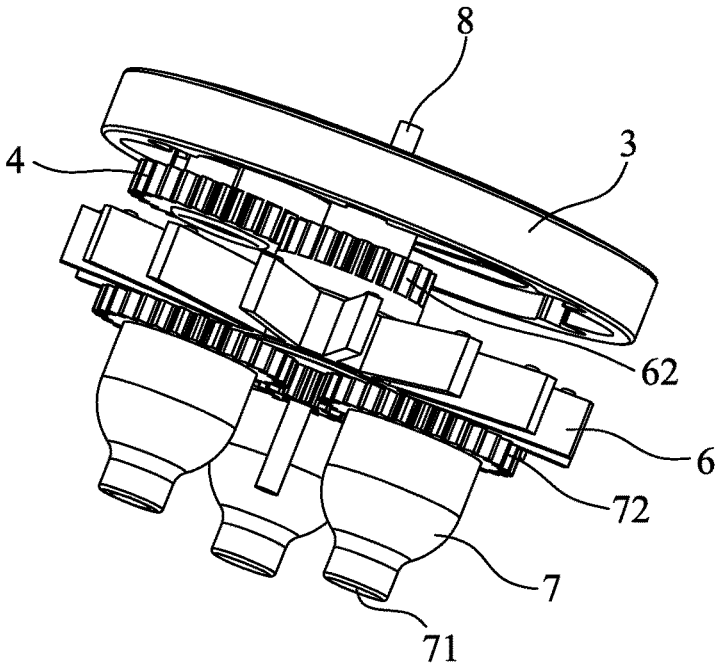
FIG. 5 is a schematically perspective view of the rotating disk, pinion, impeller and rotors operated in coordination with one another according to the present invention.

Referring to FIG. 4, the rotor 7 is a water body configured with inclined water hole 71, i.e. the water hole 71 on the rotor 7 is formed a certain angle with the rotation axis of the rotor 7, and the upper end edge of the rotor 7 is formed with a driven gear 72 in engagement with the rotating disk gear 32.

Figure 6:
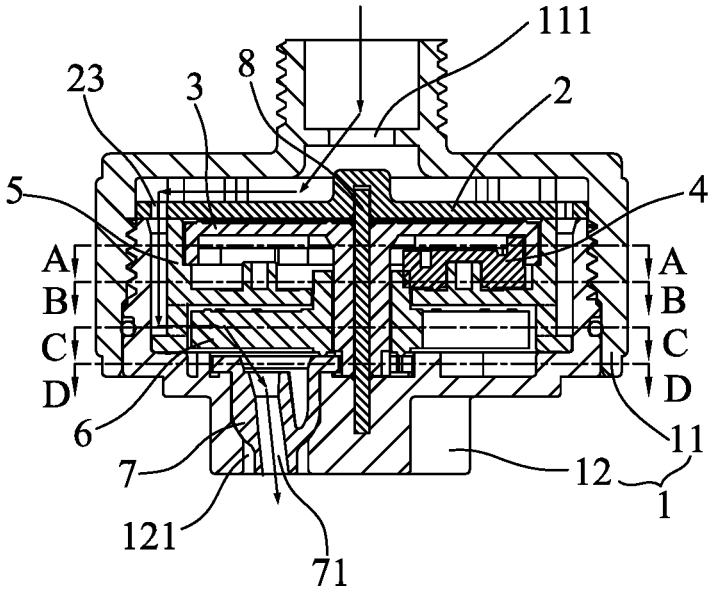
FIG. 6 is a longitudinally cross-sectional view of the present invention after assembly.

Referring to FIG. 6, upon the assembly of the shower water rotating structure of the present invention, each rotor 7 is inserted in the water outlet 121 of the lower housing 12, and the impeller 6, water inclining support 5, pinion 4 and rotating disk 3 are successively mounted thereon from bottom to top, where the axle 61 of the impeller 6 is in movable engagement with the projecting rod 31 of the rotating disk 3; the gear 32 of the rotating disk 3 is in engagement with the driven gears 72; the drive gear 62 on the rotating shaft 61 is passed through the partitioning plate 51 of the water inclining support 5 to be in engagement with the pinion 4; and a pin 8 is passed through the matching through hole 30 of the rotating disk 3 to fix the water separating disk 2 to the lower housing 12.

Referring to FIGS. 6A to 6D, according to the present invention, upon shower, water flows into main body via the water inlet 111 of the upper housing 11 and is then guided by the water separating disk 3 to flow into the water inclining support 5 from the side face thereof. Thereafter, the water enters the lower seat 53 via the inclined water inlet 56 of the water inclining support 5 and impacts the impeller 6 to cause it to rotate. Further, the drive gear 62 of the impeller 6 drives the pinion 4 to rotate; the guide rod 41 is moved along the guide groove 33 of the rotating disk 3 upon the rotation of the pinion 4 to poke the rotating disk 3 to rotate; and the gear 32 of the rotating disk 3 drives the rotors 7 to rotate such that the spray emitted from the rotors 7 is then formed into rotating spray. Furthermore, the rotating disk 3 is stopped rotating when the guide rod 41 of the pinion 4 is rotated to the range of the deep seat 36 of the rotating disk 3 from the previous guide groove 33, and the guide rod 41 does not drive the rotating disk 3 to rotate until it slides into the next guide groove 33 in such a way to make the rotors 7 to output rotating spray of an intermittent pulse type, making a human body feel more obvious on the rotating spray.

In this embodiment, the gear ratio of the drive gear 62 of the impeller 6 and pinion 4 is set to 22:28, the one of the pinion 4 and gear 32 of the rotating disk 3 1:6, and the one of the gear 32 and driven gear 72 of the rotor 7 12:30 so that the total transmission ratio of the entire gear reduction mechanism is 240:11. In addition, the number of the guide groove 33 on the rotating disk 3 is set to 6, and the one of rotors 7 is set to 3.

Referring to FIG. 3, the guide rod 41 of the pinion 4 and the guide groove 31 of the rotating disk 3 are fit in a sliding way to form a sliding pair, while the guide concave arc 34 of the rotating disk 3 and the guide convex arc 42 of the pinion 4 play guide and stability roles when the guide rod 41 is being slid out of the guide groove 33. Furthermore, the constant rotation of the pinion 4 is changed to intermittent motion of the rotating disk 3; the pinion 4 rotates one turn, and the rotating disk 3 rotates one groove position, i.e. 60 degrees, where the rotating disk 3 is moved during ⅔ unit time and stopped during another ⅓ unit time if one turn rotation of the pinion 4 takes one unit time.

Figure 6A:
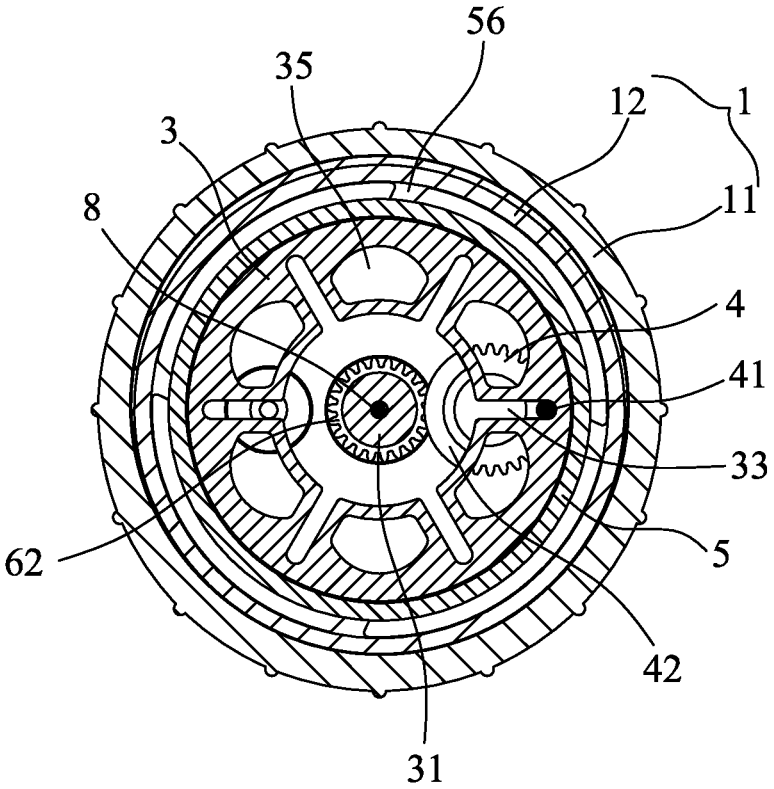
FIG. 6A is a cross sectional view of the present invention taken along line A-A of FIG. 6.
Figures 1, 6A:
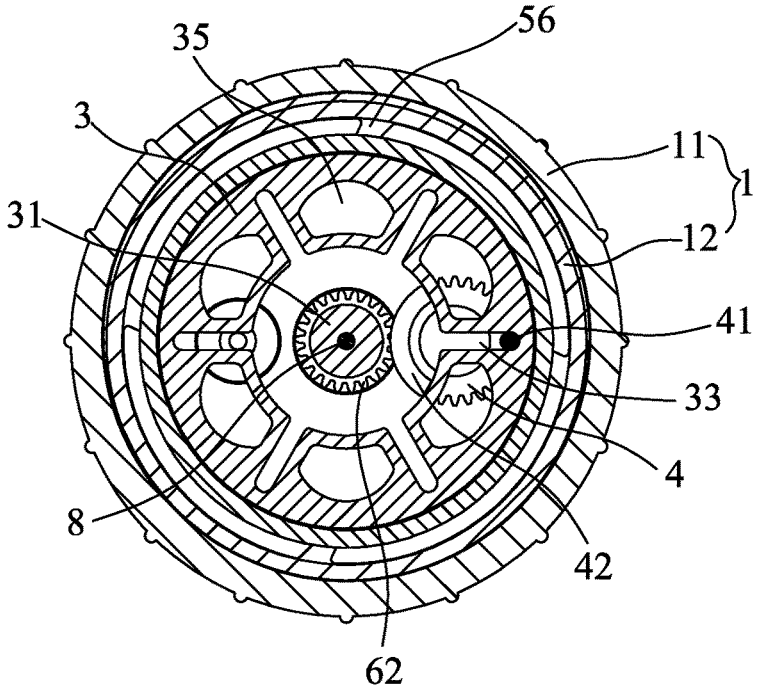
Figures 2, 6A:
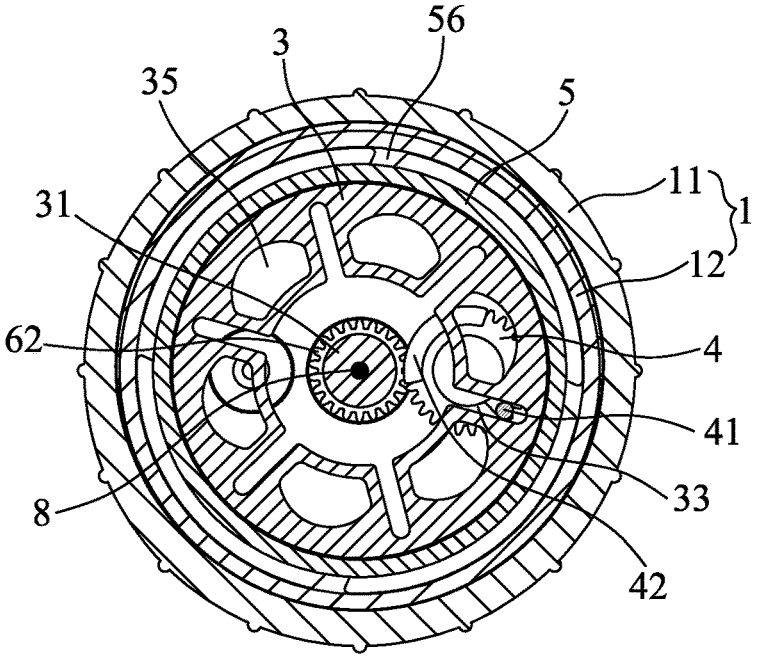
Figures 3, 6A:
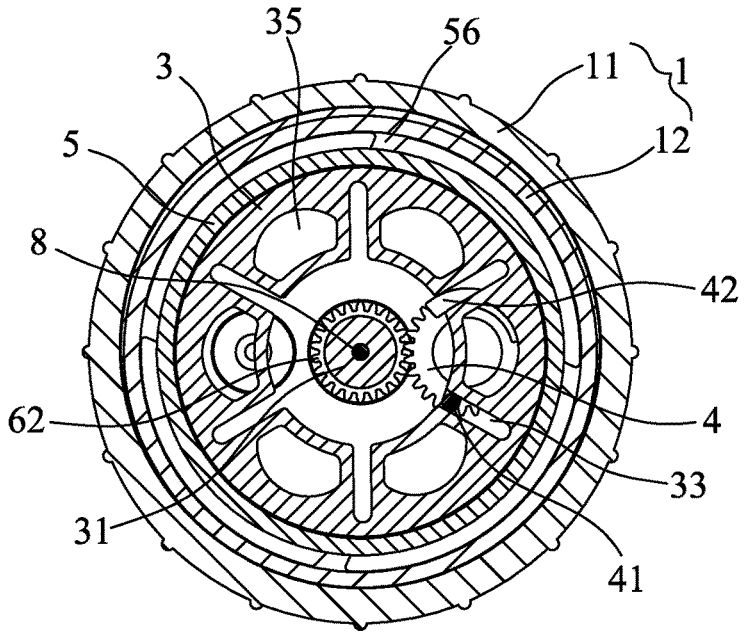
Figures 4, 6A:
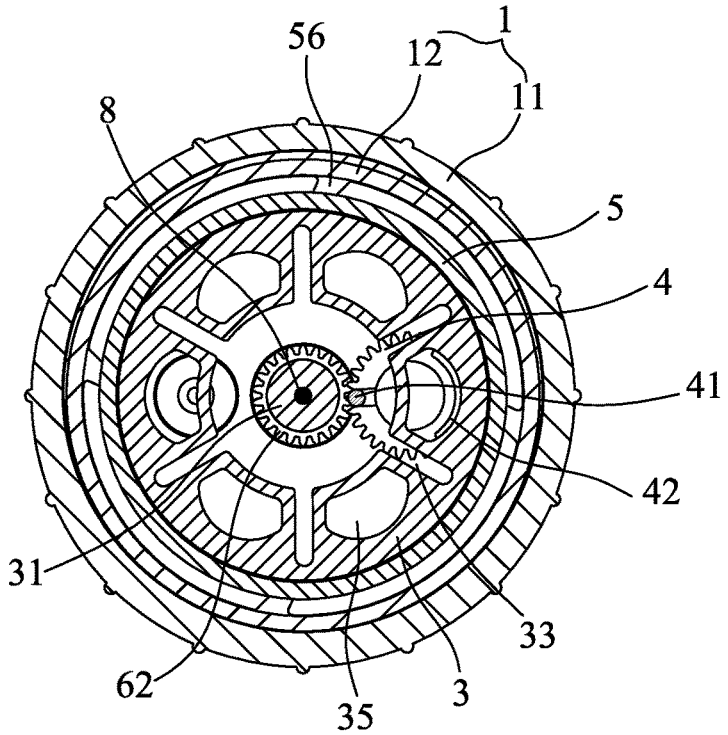
Figures 5, 6A:
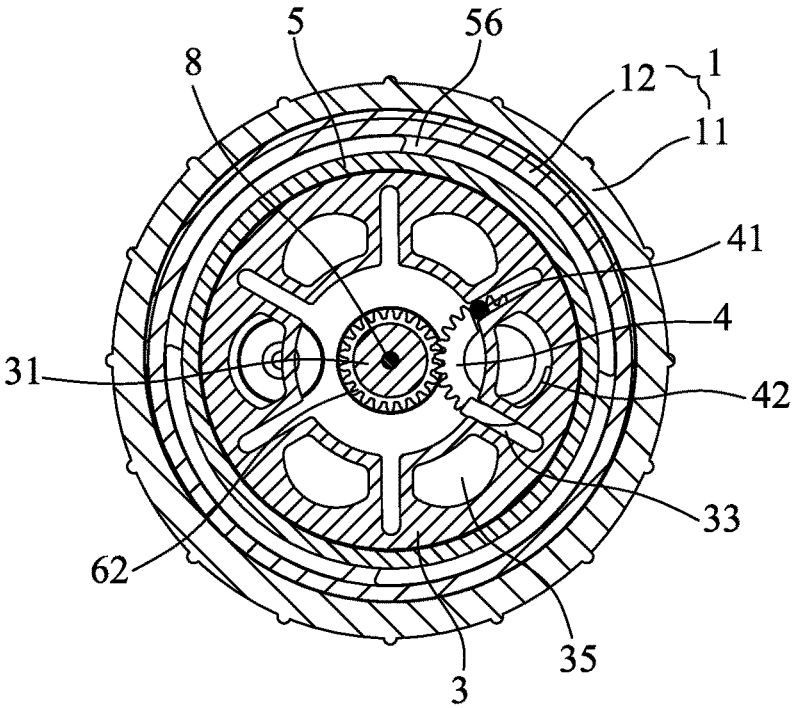
Figures 6, 6A:
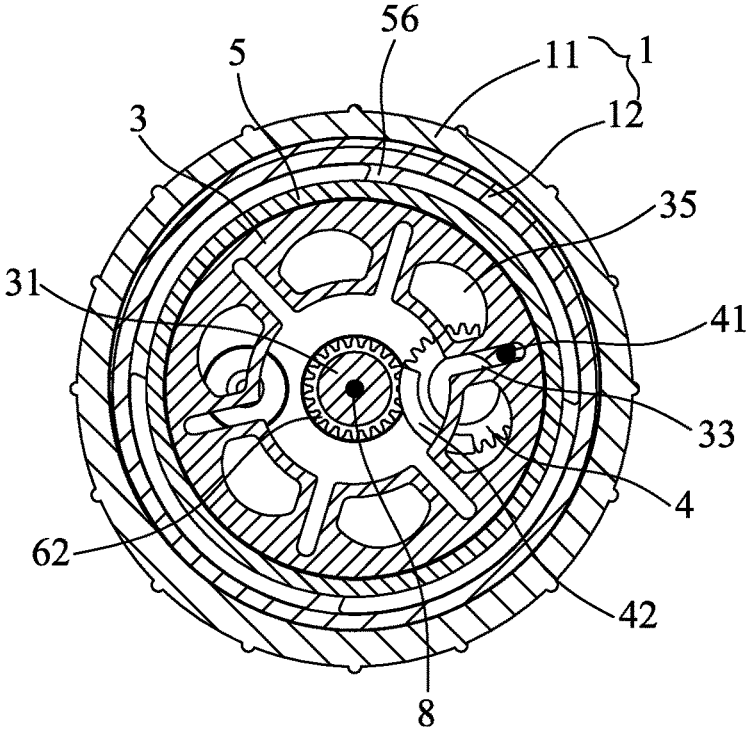
Figure 6B:
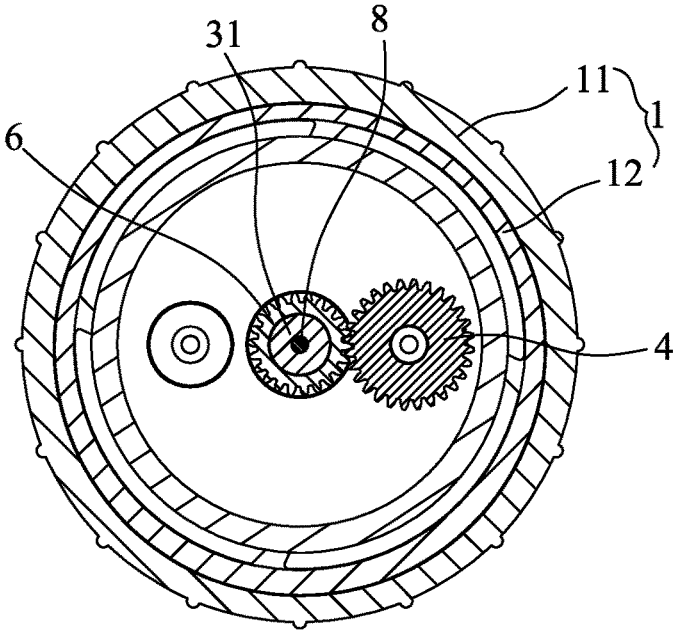
FIG. 6B is a cross sectional view of the present invention taken along line B-B of FIG. 6.
Figure 6C:
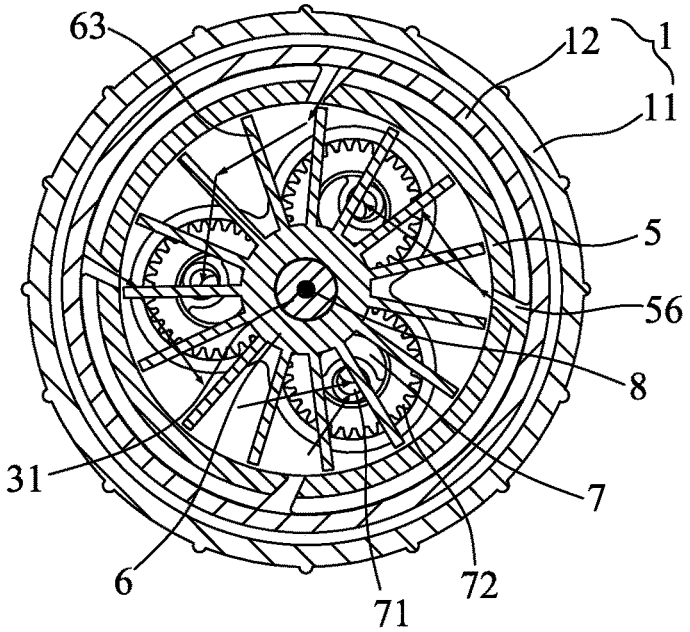
FIG. 6C is a cross sectional view of the present invention taken along line C-C of FIG. 6.
Figure 6D:
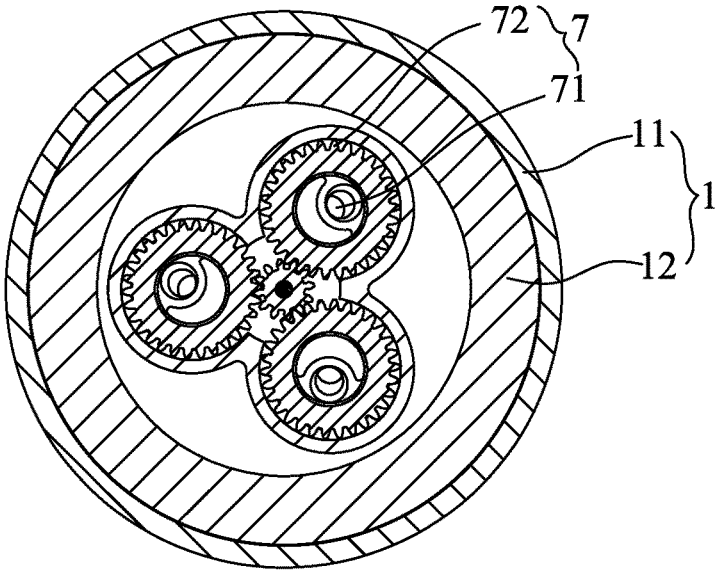
FIG. 6D is a cross sectional view of the present invention taken along line D-D of FIG. 6.

Referring to FIGS. 6A-1 to 6A-6, the pinion 4 drives the rotating disk 3 to rotate; the rotating disk 3 is rotated ⅙ turn if the pinion rotates one turn, while the pinion 4 has no action with the rotating disk 3 during ⅓ of each rotation, namely, the rotating disk 3 is in a static state, so that the rotating disk 3 is not rotated continuously but intermittently. Thereupon, the spray is sprayed out in a conically spiral shape when the rotor 7 is rotated because the rotating disk 3 drives the rotor 7 to rotate and the water hole 71 on the rotor 7 is formed a certain angle with the rotation axis of the rotor 7, and the spray is sprayed out along the axle center of the water hole 71 in a straight line shape when the rotor 7 is stopped.

Figure 7:
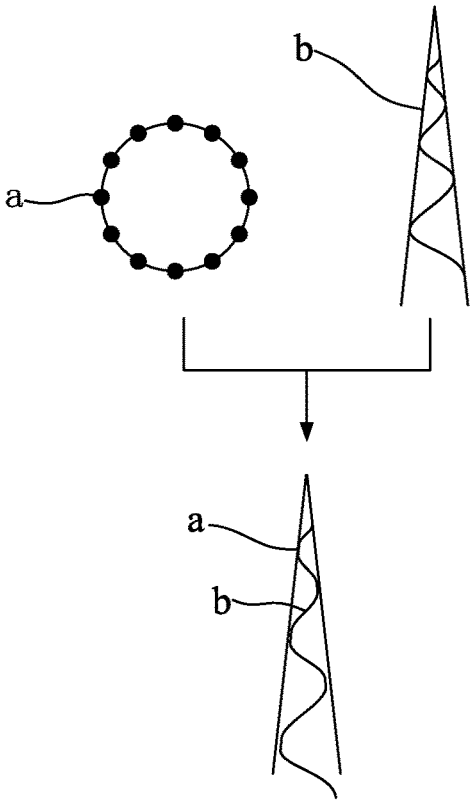
FIG. 7 is a diagram, showing a working principle of shower water output according to the present invention.

The shower water rotating structure of the present invention outputs an spray with intermittent pauses and a conically spiral shape, which is between rotating water and massage water, having a more obvious pulsating and soft massage effect. Referring to FIG. 7, which shows a spray formation principle of the present invention, the original continuous output rotation is caused to change into an intermittent rotation because the pinion 4 driving the rotating disk 3 is an intermittent motion; the water flow is not rotated when the rotors 7 are stopped (see stopping point a in the figure), the rotors 7 being kept spraying out water at a certain angle at this time, and the water flow is rotated around the axis when the rotors 7 are rotated, the spray is in a rotation state (see the rotation state b in the figure) at this time.

To sum up, the present invention realizes spray having a pulsating rotating water effect, improving the massage effect of shower water and allowing shower to be more comfortable and relax by driving the pinion 4 adapted to push the rotating disk 3 to rotate intermittently with the impeller 6 and then driving the rotor 7 having the inclined water hole 71 with the rotating disk 3.

Additional advantages and modifications will readily occur to those skilled in the art. Therefore, the invention in its broader aspects is not limited to the specific details and representative embodiments shown and described herein. Accordingly, various modifications may be made without departing from the claims or scope of the general inventive concept as defined by the appended claims and their equivalents.

We claim:

1. A shower water rotating structure, comprising a main body having a water inlet and a water outlet, and a rotating disk, pinion, water inclining support, impeller and rotors arranged inside said main body, said water inclining support having an inclined water inlet adapted to guide water flow to impact said impeller to rotate, said impeller further comprising a drive gear which drives said pinion to rotate, said pinion being configured with a guide rod adapted to drive said rotating disk to rotate, said rotating disk being distributed radially with guide grooves for matching with said guide rod, and a lower part of rotating disk being configured with a gear adapted to drive said rotors having an inclined water hole and capable of being rotated in said water outlet of said main body;

wherein said rotating disk is a circular disk body, a projecting rod matching with a through hole is extended downward from a middle part of said circular disk body, the gear is configured on a lower end of said projecting rod, guide grooves are distributed radially on a lower surface of said circular disk body, a closed positioning seat for the positioning of said pinion is formed between each two said adjacent guide grooves, and a deep seat allowing said guide rod of said pinion to be passed through is formed between each said positioning seat and said projecting rod.

2. The structure according to claim 1, wherein an upper part of said rotating disk is further configured with a water separating disk, and a peripheral of said water separating disk is configured with water passing gaps.

3. The structure according to claim 2, wherein said water separating disk is a disk body, an upper surface of the water separating disk is formed with convex edges, notches are distributed on said convex edges, and said water passing gaps are distributed on said water separating disk outside said convex edges.

4. The structure according to claim 1, wherein a guide concave arc is formed on a periphery of the lower surface of said circular disk body between each two adjacent said guide grooves.

5. The structure according to claim 4, wherein the guide rod is configured on a matching face of said pinion with said rotating disk close to a periphery thereof, and a guide convex arc operated in coordination with said guide concave arc is configured on an opposite side to said guide rod.

6. The structure according to claim 5, wherein a positioning rod operated in coordination with said positioning seat of said rotating disk is formed on a middle part of said pinion between said guide rod and guide convex arc of said pinion, and another side of said positioning rod is formed with an engagement seat matching with said water inclining support.

7. The structure according to claim 1, wherein said water inclining support is a post cover, a middle part thereof is formed into a partitioning plate adapted to divide said post cover into an upper seat and lower seat, the middle part of said partitioning plate is configured with a matching hole allowing said drive gear of said impeller to be passed through, one side of said matching hole of said partitioning plate is configured with a projecting bar matching with said pinion, said rotating disk and pinion are accepted inside said upper seat, said impeller is accepted inside said lower seat, and said inclined water inlets are configured on a side wall of said lower seat.

8. The structure according to claim 1, wherein said drive gear in engagement with said pinion is configured on an upper part of an axle of said impeller with an engagement hole, and a periphery of a lower part of said axle is formed with leaves, said axle of said impeller allowing said projecting rod of said rotating disk to be passed through.

9. The structure according to claim 1, wherein said inclined water holes of said rotors have an included angle with a rotation axis of said rotors, and an upper end edge of said rotors is formed with a driven gear in engagement with said gear of said rotating disk.

* * * * *